United States Patent [19]

Watanabe

[11] 4,207,815

[45] Jun. 17, 1980

[54] ROTARY PRESS WITH MEANS FOR ADJUSTING THE POSITIONS OF PRINTING PLATES ON PLATE CYLINDERS

[75] Inventor: Seiichi Watanabe, Yokohama, Japan

[73] Assignee: Kabushiki Kaisha Tokyo Kikai Seisakusho, Tokyo, Japan

[21] Appl. No.: 900,416

[22] Filed: Apr. 27, 1978

[30] Foreign Application Priority Data

Apr. 27, 1977 [JP] Japan ..... 52-47812

[51] Int. Cl.[2] ..... B41F 13/16

[52] U.S. Cl. ..... 101/248; 101/216; 101/415.1; 101/181

[58] Field of Search ..... 101/248, 216, 181, 183, 101/368, 415.1, 378, 249, 384–388, 110

[56] References Cited

U.S. PATENT DOCUMENTS

| | | | |
|---|---|---|---|
| 664,584 | 12/1900 | Roesen | 101/249 |
| 1,512,994 | 10/1924 | Margnardt | 101/248 |
| 1,651,295 | 11/1927 | Shuttleworth | 101/248 |
| 2,030,027 | 2/1936 | Greenwood | 101/248 |
| 2,539,068 | 1/1951 | Funk | 101/248 |
| 3,157,116 | 11/1964 | Reiner | 101/110 |
| 3,641,933 | 2/1972 | Jafel | 101/248 |
| 3,841,216 | 10/1974 | Huffman | 101/181 |
| 4,006,685 | 2/1977 | Mosemiller | 101/248 |
| 4,137,845 | 2/1979 | Jeschke | 101/248 |

*Primary Examiner*—William Pieprz

*Attorney, Agent, or Firm*—Armstrong, Nikaido, Marmelstein & Kubovcik

[57] ABSTRACT

A multiple-color, offset rotary press is disclosed wherein each plate cylinder carries two printing plates, with one of them wrapped around a larger diameter portion of the plate cylinder and the other around a tube slidably fitted over a smaller diameter portion of the cylinder. A shaft secured to the tube and extending coaxially from one end of the plate cylinder, and an axle extending coaxially from the other cylinder end, are mounted on frame means for independent rotary and axial motion. A pair of driven helical gears are mounted respectively on the shaft and the axle for simultaneous rotation therewith but for axial motion relative to same and are meshed respectively with a pair of driving helical gears fixedly mounted on the opposite axles of a corresponding blanket cylinder. The positions of the printing plates are separately adjusted in the circumferential direction by causing axial motion of the driven helical gears, and in the axial direction by causing axial motion of the shaft and the axle.

10 Claims, 7 Drawing Figures

ROTARY PRESS WITH MEANS FOR ADJUSTING THE POSITIONS OF PRINTING PLATES ON PLATE CYLINDERS

BACKGROUND OF THE INVENTION

1. Field of the Invention

This invention pertains to printing presses, and in particular to a rotary press of the type wherein a plate cylinder carries two printing plates in side-by-side arrangement. Still more particularly, the invention is directed to improved means for adjusting the positions of the printing plates in both axial and circumferential directions of the plate cylinder, as for the precise registration of various color impressions in color printing.

2. Description of the Prior Art

The side-by-side arrangement of two printing plates on a single plate cylinder has been resorted to extensively, as in the case where the plant is not equipped to manufacture printing plates large enough to singly cover the plate cylinder, or where such large plates, if manufactured at all, would be inconvenient or difficult to handle. Usually, the two printing plates are fastened to the plate cylinder at points angularly displaced from each other, so that the fastening points may not be simultaneously subjected to pressure in printing.

In the case of multiple-color printing, for example, the exact positioning of the printing plates on several plate cylinders is necessary for proper registration of the colored impressions on paper or other surface. Such exact positioning of the printing plates is difficult to attain, however, because of the manufacturing errors of the printing plates and of the means for fastening same to the plate cylinders.

Some prior art multiple-color rotary presses are equipped with means for adjusting the position of one of the printing plates on each plate cylinder, but manual readjustment is usually necessary for the other printing plate. Such adjustment of the printing plate positions according to the prior art involves a highly troublesome and time-consuming procedure, imposing prolonged downtime upon the press.

SUMMARY OF THE INVENTION

It is an object of this invention to provide simple, compact and reliable means for speedy, fine adjustment of the positions of two printing plates wrapped side by side around a plate cylinder of a rotary press, in both axial and circumferential directions of the cylinder.

Another object of the invention is to provide such improved means which permit adjustment of the printing plate positions as above regardless of whether the press is in or out of operation.

With these and other objects in view, the invention is directed, in brief, to a rotary press of the type wherein two printing plates are to be carried on a single plate cylinder, with one of the plates wrapped around a larger diameter portion of the cylinder and the other around a tube or sleeve which is fitted over a smaller diameter portion of the cylinder for sliding motion in both circumferential and axial directions. The invention comprises a shaft secured to the tube and extending coaxially from one end to the plate cylinder, and an axle secured to and extending coaxially from the other end of the plate cylinder, which shaft and axle are mounted on frame means for independent rotary and axial motion. Mounted respectively on the shaft and the axle for simultaneous rotation therewith but for axial motion relative to same, a pair of driven helical gears are in mesh respectively with a pair of driving helical gears which are restrained from axial motion with respect to the driven helical gears. Also included are means for causing axial motion of each driven helical gear and hence for adjusting the position of the corresponding printing plate in the circumferential direction, and means for causing axial motion of each of the shaft and the axle and hence for adjusting the position of the corresponding printing plate in the axial direction.

In a preferred embodiment, in which the invention is adapted for a multiple-color, offset rotary press, the pair of driving helical gears are mounted on the opposite axles of each of blanket cylinders interposed between the respective plate cylinders and a common impression cylinder. The means for causing axial motion of each driven helical gear, and the means for causing axial motion of each of the shaft and the axle associated with each plate cylinder, are both actuated by reversible electric motors included therein. The relative positions of the printing plates on all the plate cylinders can therefore be readily adjusted in both circumferential and axial directions by setting the corresponding motors in rotation in either direction, while the press is in operation.

The above and other objects, features and advantages of this invention and the manner of attaining them will become more clearly apparent, and the invention itself will best be understood, from the following description of a preferred embodiment taken in connection with the accompanying drawings.

DESCRIPTION OF THE PREFERRED EMBODIMENT

Figure 1:
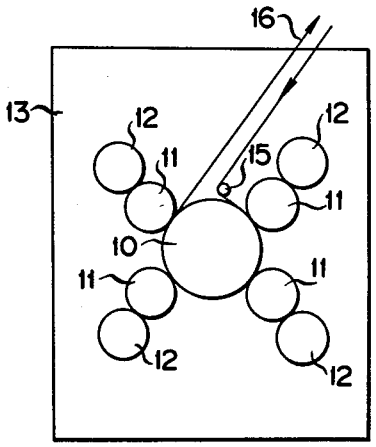
FIG. 1 is a schematic representation explanatory of the arrangement of various cylinders in a multiple-color, web-fed, offset rotary press to which the present invention is applicable.

The invention will hereinafter be described in detail as adapted specifically for a multiple-color, web-fed, offset rotary press. With reference to FIG. 1, which is explanatory of the arrangement of various cylinders in the rotary press of the type in question, there is shown at 10 an impression cylinder of comparatively large diameter. Tangent to this impression cylinder, at constant circumferential spacings, are a plurality of, four in this particular embodiment, rubber-blanketed cylinders 11 which further are in rolling contact with respective plate cylinders 12. All these cylinders 10, 11 and 12 extend between, and are rotatably mounted on, a pair of confronting frame walls 13 and 14 (FIG. 2).

Guided by a guide roll 15, web 16 of paper to be printed upon is wrapped around the impression cylinder 10 and travels as indicated by the arrowheads in FIG. 1. As is well known, the several colors of the printed image are transferred from the plate cylinders 12 to the blanket cylinders 11 and are then offset or transferred to the web 16 by pressure applied to the impression cylinder 10.

Figure 2:
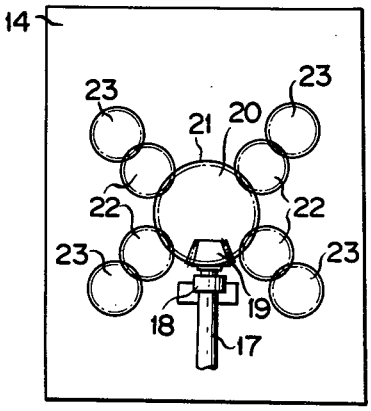
FIG. 2 is a similar representation explanatory of the drive mechanism of the press of FIG. 1.

FIG. 2 schematically illustrates the drive mechanism of this multiple-color rotary press, which includes an upright drive shaft 17 rotatably journalled in a bearing 18 on the frame wall 14. The drive shaft 17 carries on its top end a bevel pinion 19 which is in mesh with a bevel gear 20 fixedly mounted on the axle of the impression cylinder 10. Also fixedly mounted on the impression cylinder axle is a helical gear 21 which is in mesh with four other helical gears 22 fixedly mounted on the respective axles of the blanket cylinders 11. The helical gears 22 are each in mesh with one of additional four helical gears 23 mounted on the respective axles of the plate cylinders 12.

The rotation of the drive shaft 17, which is connected to an electric motor or the like (not shown), is therefore imparted to the impression cylinder 10 via the bevel gearing 19,20. The rotation of this impression cylinder is further transmitted to the blanket cylinders 11 and thence to the plate cylinders 12 via the helical gearings 21, 22, 23. This drive mechanism is disposed on that side of the frame wall 14 opposite to the side where the aforesaid cylinders 10, 11 and 12 are mounted. The reason for the use of the helical gears will become apparent as the description proceeds.

Figure 3:
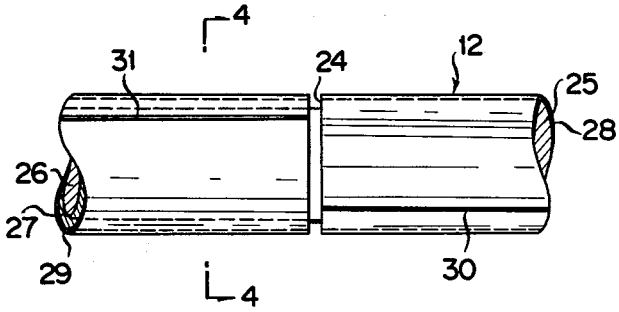
FIG. 3 is an enlarged, fragmentary elevational view of one of the plate cylinders in the press of FIGS. 1 and 2.
Figure 4:
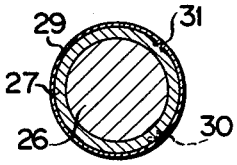
FIG. 4 is a sectional view taken along the line 4—4 of FIG. 3.

The four plate cylinders 12 are all of identical construction, one of them being shown in detail in FIGS. 3 and 4. Each plate cylinder 12 is stepped at 24, in the middle of its axial dimension, to provide a larger diameter portion 25 and a smaller diameter portion 26. A tube or sleeve 27 of the same outside diameter as the larger diameter portion 25 is fitted over the smaller diameter portion 26 for both rotary and axial sliding motion.

Each plate cylinder 12 of the foregoing configuration carries two printing plates 28 and 29, one of which is wrapped directly around the larger diameter portion 25 and the other around the tube 27 on the smaller diameter portion 26. The two printing plates 28 and 29 are fastened to the larger diameter portion 25 and the tube 27 at 30 and 31, respectively, which fastening points are out of phase or angularly displaced from each other, for the reason set forth previously. The positions of these two printing plates on each plate cylinder, in relation to those of the printing plates on the other plate cylinders, are to be adjusted in both circumferential and axial directions by the improved means of this invention hereinafter described with reference to FIGS. 5 and 6.

Figure 5:
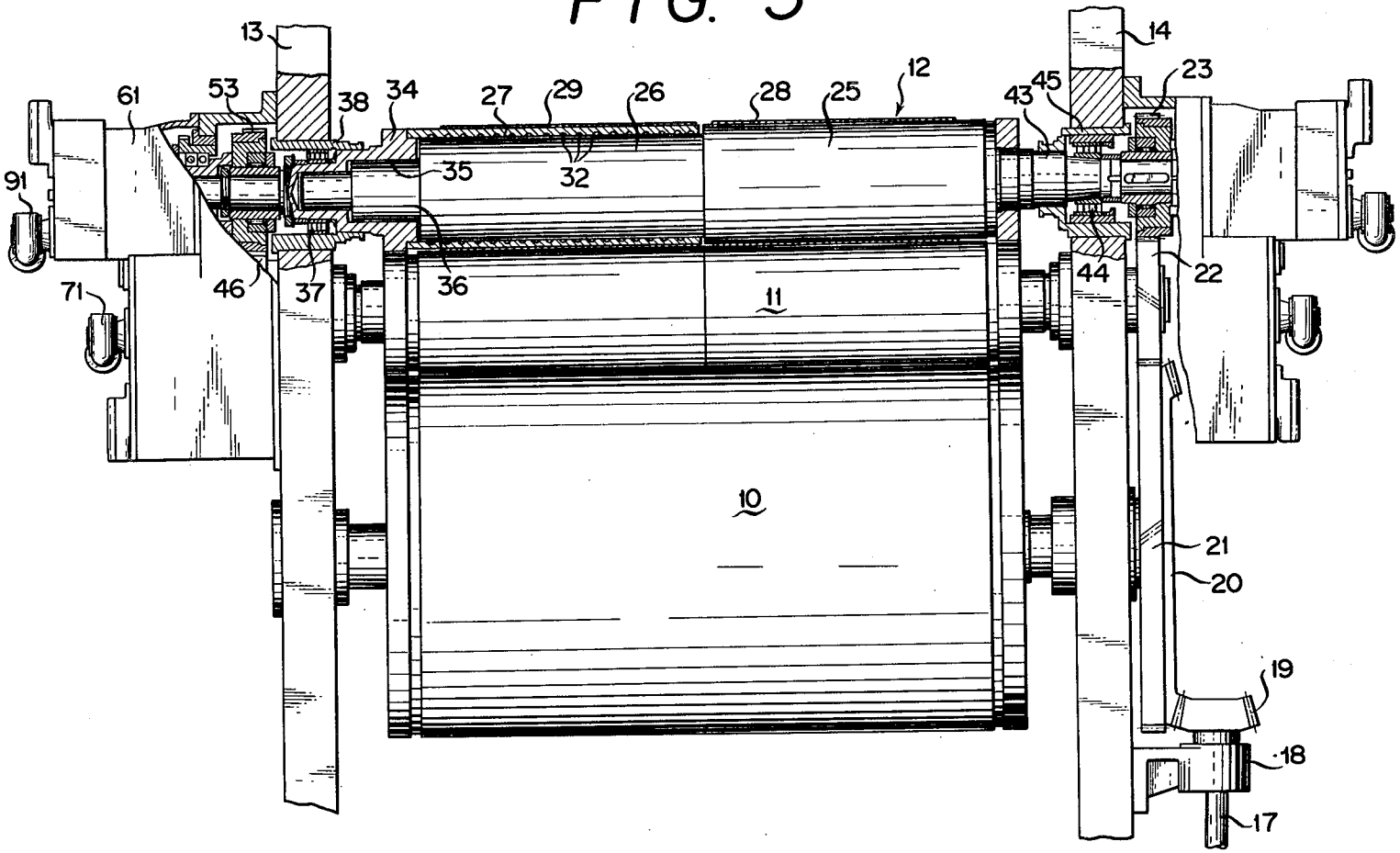
FIG. 5 is an enlarged elevational view, partly broken away and partly sectioned, of the press of FIGS. 1 and 2, the view showing only one of the plate cylinders, together with an associated blanket cylinder and a common impression cylinder, and the means for adjusting the positions of the printing plates on the illustrated plate cylinder.
Figure 6:
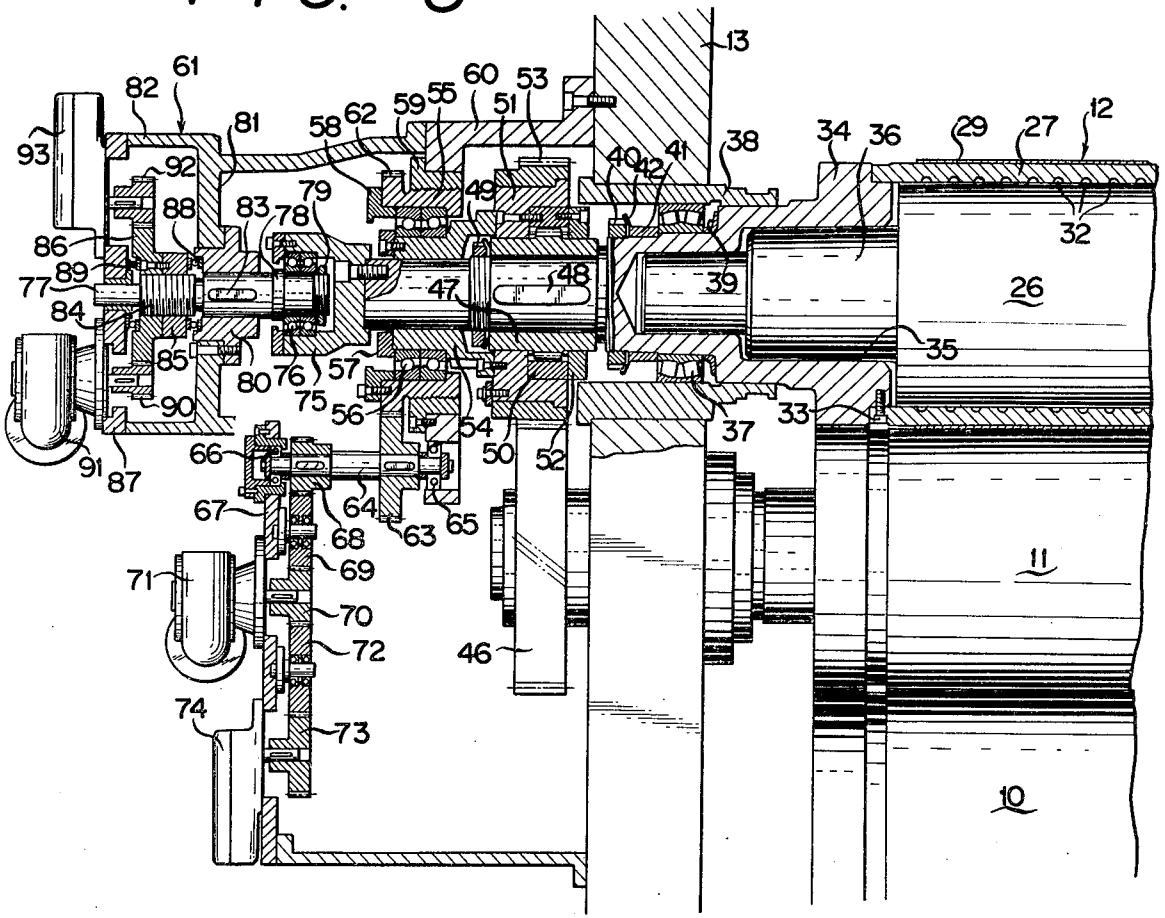
FIG. 6 is a still more enlarged, fragmentary sectional view showing in greater detail the means for adjusting the position of the printing plate wrapped around a tube on the smaller diameter portion of the plate cylinder of FIG. 5.

In order to facilitate illustration and description, FIGS. 5 and 6 show only one of the plate cylinders 12, together with the corresponding one of the blanket cylinders 11 and the common impression cylinder 10, and the means for adjusting the positions of the printing plates on that one plate cylinder. It is understood that the positions of the printing plates on each of the other unshown plate cylinders are adjusted by identical means.

FIGS. 5 and 6 clearly illustrates a multiplicity of grooves 32 or similar depressions formed in the inside surface of the tube 27. Such depressions are intended to reduce to a minimum the frictional resistance offered against the sliding motion of the tube 27 on the plate cylinder smaller diameter portion 26. The tube 27 is screwed or otherwise fastened as at 33, FIG. 6, to a stepped shaft 34 extending away from the end of the plate cylinder smaller diameter portion 26 in axial alignment therewith. The shaft 34 is partly hollowed at 35 to receive the plate cylinder axle 36 so as to permit both rotary and axial sliding motion thereof.

The shaft 34 is rotatably journalled in a roller bearing 37 mounted within a bushing 38 which in turn is inserted into a bore formed in the frame wall 13. A shim 39 is mounted between the inner race of the bearing 37 and one of the annular shoulders of the shaft 34. On the other side of the bearing 37, a locknut 40 is fitted over the shaft 34 to prevent axial displacement of the bearing via a collar 41 and washer 42. The outer race of the bearing 37 is fitted in the bushing 38 for axial sliding motion. It is thus seen that the shaft 34, as well as the tube 27 secured thereto, is both rotatable and, within limits, movable axially relative to the frame wall 13.

Projecting coaxially from the end of the plate cylinder larger diameter portion 25 in fixed relationship thereto, a stepped axle 43 is rotatably journalled in a roller bearing 44 within a bushing 45 which is inserted into a bore formed in the frame wall 14. The bearing 44 is also slidable axially relative to the bushing 45, so that the axle 43, as well as the plate cylinder 12 (except the tube 27 on its smaller diameter portion 26) secured thereto, is both rotatable and movable axially relative to the frame wall 14.

As mentioned in connection with FIG. 2, the driven helical gear 23 is mounted on the axle 43 of the plate cylinder 12, in the manner hereinafter made apparent. This driven helical gear 23 is in mesh with the driving helical gear 22 on one of the opposite axles of the blanket cylinder 11. Another driving helical gear 46 is mounted on the other axle of the blanket cylinder 11. The driving helical gears 22 and 46 on the blanket cylinder axles are of the same diameter, and both are rotatable but restrained from axial motion relative to the frame walls 13 and 14.

With particular reference to FIG. 6, an external spur gear 47 is mounted on the shaft 34 and is locked against either rotary or axial motion relative to the latter by a key 48 and a locknut 49. In mesh with this external spur gear 47 is an internal spur gear 50 which is slidable axially relative to the external spur gear and which is screwed or otherwise fastened to a connector ring 51 with the aid of a retainer ring 52. Also secured to the connector ring 51 is a driven helical gear 53 which is in coaxial relationship to the shaft 34 and which is in mesh with the driving helical gear 46 on the blanket cylinder axle.

It is thus seen that the driven helical gear 53 is movable axially, within limits, relative to the shaft 34 but is locked against rotation relative to same, by the intermeshing external and internal spur gears 47 and 50. The driven helical gear 53 is of the same diameter as the other driven helical gear 23, which is mounted on the plate cylinder axle 43 in the same fashion as the driven helical gear 53 is mounted on the shaft 34. Thus, as the pair of interconnected driving helical gears 22 and 46 on the blanket cylinder axles rotate, the two printing plates 28 and 29 on the plate cylinder 12 are thereby rotated at synchronous speed via the driven helical gear 23 and the axle 43 and via the driven helical gear 53 and the shaft 34, even though the tube 27 carrying the printing plate 29 is slidably fitted over the plate cylinder smaller diameter portion 26.

Described in the following is the mechanism for adjusting the position of the printing plate 29 on the tube 27 in the circumferential direction of the plate cylinder smaller diameter portion 26. This objective can be accomplished by adjustably moving the driven helical gear 53 in the axial direction relative to the driving helical gear 46 and to the shaft 34, in the following manner.

A sleeve 54 is slidably fitted over the shaft 34 and has its belled end screwed or otherwise fastened to the connector ring 51. Around this sleeve 54 an externally screw-threaded ring or tube 55 is rotatably supported via an angular-contact bearing 56. The inner and outer races of the angular-contact bearing 56 are secured to the sleeve 54 and the externally screw-threaded ring 55 by retainer rings 57 and 58, respectively. The externally screw-threaded ring 55 is in engagement with an internally screw-threaded, flanged ring or tube 59 which is immovably supported by a part 60 of an enclosure 61 housing the various moving parts of the printing plate adjusting mechanisms. The enclosure 61 is fixedly mounted on the frame wall 13.

The externally screw-threaded ring 55 is formed integral with a gear 62 which is in mesh with a pinion 63 fixedly mounted on a spindle 64. At its opposite ends the spindle 64 is rotatably journalled in bearings 65 and 66 which are supported respectively by the part 60 and an end cover 67 of the enclosure 61. Also fixedly mounted on this spindle 64 is a driven gear 68 which is in mesh with an idler gear 69 and thence with a drive gear 70 mounted on the output shaft of a reversible electric motor 71. The drive gear 70 is also in mesh, via an idler gear 72, with a gear 73 on the input shaft of a revolution sensor 74, as of the potentiometer type.

The rotation of the motor 71 in either direction is therefore transmitted through the intermeshing gears 68, 69 and 70 and the spindle 64 to the pinion 63 thereby causing rotation of the gear 62 integral with the externally screw-threaded ring 55. The rotation of the gear 62 is translated into the axial motion of the ring 55 by the internally screw-threaded ring 59 in engagement therewith, and this axial motion is transmitted to the driven helical gear 53 via the sleeve 54 and the connector 51.

What follows is the description of the mechanism for adjusting the position of the printing plate 29 on the tube 27 in the axial direction of the plate cylinder smaller diameter portion 26. A cup-shaped bearing support 75 is fastened concentrically to the end of the shaft 34, with its open end directed away from the shaft. Connected to this bearing support 75, via a bearing 76, is a spindle 77 which is in axial alignment with the shaft 34. The shaft 34 is free to rotate relative to the spindle 77 but any relative axial motion of the shaft and the spindle is prevented by a collar 78 and a locknut 79 disposed on the opposite sides of the bearing 76.

A bushing 80 is fixedly mounted in a bore formed in a supporting wall 81 within a part 82 of the enclosure 61 which is fastened to the aforesaid enclosure part 60. The spindle 77 slidably extends through the bushing 80 and is constrained to axial motion only relative to same by a key 83. The spindle 77 is externally screw-threaded at 84, and an internally screw-threaded ring 85 is engaged therewith. This ring 85 is shown to be fastened to a gear 86 which is bored axially therethrough and internally screw-threaded for engagement with the thread 84 on the spindle 77. The rigidly interconnected ring 85 and gear 86 are restrained from axial motion by the bushing 80 and an enclosure end cover 87 via thrust bearings 88 and 89 but are rotatable around the spindle 77.

The gear 86 is in mesh with a drive pinion 90 on the output shaft of a second reversible electric motor 91. Also in mesh with the gear 86 is another pinion 92 on the input shaft of a revolution sensor 93, as of the potentiometer type.

As will be seen by referring back to FIG. 5, the printing plate 28 on the plate cylinder larger diameter portion 25 can be adjustably moved in both circumferential and axial directions, in relation to the printing plates on the larger diameter portions of the other plate cylinders, by mechanisms similar to those for the printing plate 29 on the tube 27. The only difference is that the axle 43 performs the functions of the shaft 34.

OPERATION

In the multiple-color, offset rotary press of the above described configuration, the impression cylinder 10, the blanket cylinders 11 and the plate cylinders 12 (including the tubes 27 on their smaller diameter portions 26) are all rotated from the common drive shaft 17, in the manner already set forth. The multiple-color images are printed as aforesaid on the paper web 16 as same travels around the impression cylinder 10.

For the adjustment of the position of the printing plate 29 on the tube 27 of one of the plate cylinders 12 in its circumferential direction, the corresponding one of the first reversible motors 71 is set in rotation in a desired direction. The rotation of this motor is imparted via the gearing 68, 69, 70 and the spindle 64 to the pinion 63 and thence to the gear 62 integral with the externally screw-threaded ring 55. In engagement with the fixed, internally screw-threaded ring 59, the externally screw-threaded ring 55 on rotation travels axially relative to the ring 59.

This axial motion of the externally screw-threaded ring 55 is transmitted to the driven helical gear 53 via the angularcontact bearing 56, the sleeve 54 and the connector ring 51. Thus moved axially, the driven helical gear 53 simultaneously undergoes displacement in the circumferential direction relative to the driving helical gear 46, as the teeth on these intermeshing gears are disposed oblique to the gear axes. Since the driven helical gear 53 is locked against rotation relative to the shaft 34, the tube 27 secured to this shaft also moves in the circumferential direction relative to the plate cylinder 12. The direction of movement of this tube, together with the printing plate 29 thereon, is determined by the direction of rotation of the first reversible motor 71.

For the adjustment of the position of the printing plate 29 on the tube 27 of one of the plate cylinders 12 in the axial direction, the corresponding one of the second reversible motors 91 is set in rotation in a desired direction. The consequent rotation of the gear 86, together with the ring 85 fastened thereto, is translated into the axial motion of the spindle 77 by virtue of their interengaged internal and external screw threads. Since the spindle 77 is rigidly connected to the shaft 34 in the axial direction, this shaft and the tube 27 secured thereto move axially relative to the plate cylinder 12. The direction of this axial motion of the tube 27 is also determined by the direction of rotation of the second reversible motor 91. The position of the driven helical gear 53 in relation to the driving helical gear 46 remains unchanged during such axial motion of the shaft 34, because the driven helical gear is connected to the shaft via the intermeshing external and internal spur gears 47 and 50.

It is evident from the foregoing that the adjusting operations of the printing plates 28 and 29 on each plate cylinder in the circumferential and the axial directions can be effected totally independently of each other, during the operation of the press. The degrees of movement of each printing plate in the circumferential and the axial directions can be ascertained and controlled through the revolution sensors 74 and 93.

Figure 7:
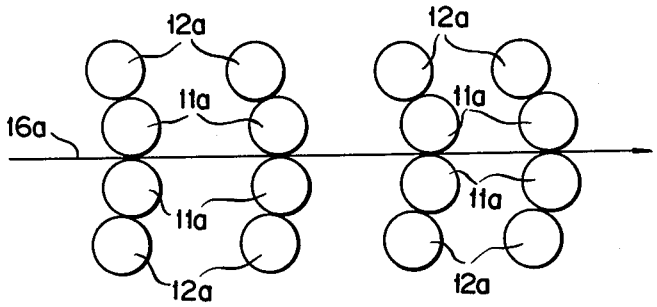
FIG. 7 is a schematic representation of an offset perfecting press to which the invention is also applicable.

The principles of this invention are applicable not only to the rotary press of the type shown in FIG. 1 but also to, for example, a web-fed, offset perfecting press schematically illustrated in FIG. 7. As is well known, this method eliminates the impression cylinder and prints both sides of the web 16*a* at one time, using the blanket cylinders 11*a* on the opposite side of the web as the impression cylinders. The two printing plates wrapped side by side around each of the plate cylinders 12*a* can be adjustably moved in both circumferential and axial directions by the same means as those shown in FIGS. 5 and 6.

It is to be understood that the foregoing detailed description is by way of example only and is not intended to impose limitations upon the present invention, since numerous modifications or changes will readily occur to those skilled in the art. For instance, the spindle 64 carrying the pinion 63 may be driven from the motor 71 not via the gearing as shown but via a chain-and-sprocket arrangement. Further, instead of the motors 71 and 91, handles may be employed for manual actuation of the adjusting mechanisms. The appended claims, therefore, are intended to cover all such modifications and changes as fall within the true spirit of the invention.

WHAT IS CLAIMED IS:

1. In a rotary press of the type including a plate cylinder having a larger diameter portion and a smaller diameter portion, and a tube which is fitted over the smaller diameter portion of the plate cylinder for sliding motion in both circumferential and axial directions, the combination thereof with:

(a) a frame;

(b) a shaft secured to the tube and extending from one end of the plate cylinder coaxially therewith;

(c) an axle extending from the other end of the plate cylinder and secured thereto coaxially therewith;

(d) means mounting the shaft and the axle on the frame so as to permit independent rotary and axial motion thereof;

(e) a pair of driving helical gears supported for simultaneous rotation and restrained from axial motion with respect to the frame;

(f) a pair of driven helical gears mounted respectively on the shaft and the axle so as to be rotatable therewith and movable axially relative thereto, the driven helical gears being in mesh with the respective driving helical gears;

(g) first and second means for independently moving each of the driven helical gears respectively in the axial direction; and (h) third and fourth means for independently moving each of the shaft and the axle respectively in the axial direction; wherein the large diameter portion of the plate cylinder and the tube fitted on the smaller diameter portion may be adjusted independently of each other in both the axial and circumferential directions during operation and non-operation of the rotary press.

2. The rotary press as set forth in claim 1, wherein each of the first and second means for independently moving each driven helical gear respectively comprises:

(a) an internally screw-threaded member supported in fixed relationship to the frame means and disposed coaxially with the shaft or the axle;

(b) an externally screw-threaded member rotatably supported in engagement with the internally screw-threaded member;

(c) means for imparting rotation to the externally screw-threaded member and hence for causing same to move axially relative to the internally screw-threaded member; and (d) means for transmitting the axial motion of the externally screw-threaded member to the driven helical gear.

3. The rotary press as set forth in claim 2, wherein the rotation-imparting means comprises:

(a) a reversible electric motor; and (b) means operatively connecting the motor to the externally screw-threaded member.

4. The rotary press as set forth in claim 3, further comprising a revolution sensor operatively connected to the motor.

5. The rotary press as set forth in claim 2, wherein the transmitting means comprises:

(a) a sleeve slidably fitted over the shaft or the axle and held in fixed relationship to the driven helical gear; and (b) a bearing mounted between the externally screw-threaded member and the sleeve.

6. The rotary press as set forth in claim 1, wherein each of the third and fourth means for independently moving each of the shaft and the axle respectively comprises:

(a) a spindle disposed in axial alignment with the shaft or the axle and constrained to axial motion relative to the frame means, the spindle being at least partly externally screw-threaded;

(b) means connecting the spindle to the shaft or the axle so as to permit rotation of the latter relative to the former and to prevent axial motion relative to each other;

(c) an internally screw-threaded member fitted over the spindle and engaged with the external screw thread thereon, the internally screw-threaded member being locked against axial motion relative to the spindle; and (d) means for imparting rotation to the internally screw-threaded member and hence for causing axial motion of the spindle.

7. The rotary press as set forth in claim 6, wherein the rotation-imparting means comprises:

(a) a reversible electric motor; and (b) means operatively connecting the motor to the internally screw-threaded member.

8. The rotary press as set forth in claim 7, further comprising a revolution sensor operatively connected to the internally screw-threaded member.

9. In a multiple-color rotary press of the type including a plurality of plate cylinders each for carrying thereon two printing plates in side-by-side relationship, with one of the printing plates wrapped around a larger diameter portion of each plate cylinder and the other printing plate around a tube which is fitted over a smaller diameter portion of the plate cylinder for sliding motion in both circumferential and axial directions, the improvement which comprises:

(a) a frame;

(b) a shaft secured to the tube on each plate cylinder and extending from the end of its smaller diameter portion coaxially therewith;

(c) an axle extending from the end of the larger diameter portion of each plate cylinder coaxially therewith and secured thereto;

(d) means mounting the shaft and the axle of each plate cylinder on the frame so as to permit independent rotary and axial motion thereof;

(e) pairs of driving helical gears rotatably supported and restrained from axial motion with respect to the frame, each pair of driving helical gears being in axial alignment and rigidly interconnected for rotation at synchronous speed;

(f) a pair of driven helical gears mounted respectively on the shaft and the axle of each plate cylinder for simultaneous rotation therewith and for axial motion relative thereto, each pair of driven helical gears being in mesh with one of the pairs of driving helical gears respectively;

(g) a first pair of internally screw-threaded members disposed coaxially with the shaft and the axle of each plate cylinder and supported in fixed relationship to the frame;

(h) a first pair of externally screw-threaded members rotatably supported in engagement with each first pair of internally screw-threaded members respectively;

(i) means for imparting rotation to each first externally screw-threaded member and hence for causing same to move axially relative to the corresponding one of the first internally screw-threaded members;

(j) means for transmitting the axial motion of each first externally screw-threaded member to the corresponding one of the driven helical gears;

(k) a second pair of externally screw-threaded members disposed in axial alignment with the shaft and the axle of each plate cylinder and constrained to axial motion relative to the frame;

(l) means connecting each second pair of externally screw-threaded members to the shaft and the axle, respectively, of one of the plate cylinders so as to prevent relative axial motion and to permit rotation of the shaft and the axle relative to the respective second externally screw-threaded members;

(m) a second pair of internally screw-threaded members rotatably supported in engagement with each second pair of externally screw-threaded members respectively and restrained from axial motion relative to the frame; and (n) means for imparting rotation to each second internally screw-threaded member and hence for causing axial motion of the corresponding one of the second externally screw-threaded members together with the corresponding one of the shaft and the axle of each plate cylinder.

10. The multiple-color rotary press as set forth in claim 9, wherein the plate cylinders are in rolling contact with respective blanket cylinders, and wherein each pair of driving helical gears are fixedly mounted on the respective opposite axles of one of the blanket cylinders.

* * * * *